US007161490B2

(12) United States Patent
Huiban

(10) Patent No.: US 7,161,490 B2
(45) Date of Patent: Jan. 9, 2007

(54) SEATING DEVICE FOR AVOIDING ERGONOMIC PROBLEMS

(75) Inventor: Cristian M. Huiban, Eindhoven (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 179 days.

(21) Appl. No.: 10/480,667

(22) PCT Filed: Jun. 20, 2002

(86) PCT No.: PCT/IB02/02359

§ 371 (c)(1),
(2), (4) Date: Dec. 12, 2003

(87) PCT Pub. No.: WO03/001946

PCT Pub. Date: Jan. 9, 2003

(65) Prior Publication Data

US 2004/0195876 A1 Oct. 7, 2004

(30) Foreign Application Priority Data

Jun. 27, 2001 (EP) ..... 01202464

(51) Int. Cl.
*G08B 23/00* (2006.01)

(52) U.S. Cl. ..... 340/573.1; 340/686.1; 340/10.52

(58) Field of Classification Search ..... 340/573.1, 340/500, 666, 667, 692, 686.1, 10.52
See application file for complete search history.

(56) References Cited

U.S. PATENT DOCUMENTS

| | | | | |
|---|---|---|---|---|
| 6,091,334 | A * | 7/2000 | Galiana et al. | 340/576 |
| 6,287,253 | B1 * | 9/2001 | Ortega et al. | 600/300 |
| 6,384,728 | B1 * | 5/2002 | Kanor et al. | 340/573.1 |
| 6,487,906 | B1 * | 12/2002 | Hock | 73/379.01 |
| 6,646,556 | B1 * | 11/2003 | Smith et al. | 340/573.1 |
| 2003/0010345 | A1 * | 1/2003 | Koblasz et al. | 128/845 |

FOREIGN PATENT DOCUMENTS

JP 08293085 5/1996

* cited by examiner

*Primary Examiner*—Phung T. Nguyen

(57) ABSTRACT

A seating device and a method include sensors of the limbs of the human body with a database with the users ergonomic data of the human body including the user's injury strain complains. A warning signal representing detected strain or damage in the limbs can be given. The ergonomic data includes the age, weight and characteristics of body limbs: neck, arms, hands, feet, legs; other abnormal shapes of body limbs; limbs, where a static situation should be avoided and preferred exercise is suggested when a warning signal is given. The warning signal can be given by lamps, light emitting diodes, a vibrator, a speaker, a buzzer, by a display or via an interface. The seating device can be remote-controlled by interfaces such as Bluetooth, IrDa, USB, or controlled by a computer integrated in the seating device. The sensors include pressure, temperature, proximity or camera.

21 Claims, 3 Drawing Sheets

SEATING DEVICE FOR AVOIDING ERGONOMIC PROBLEMS

Figure 1:
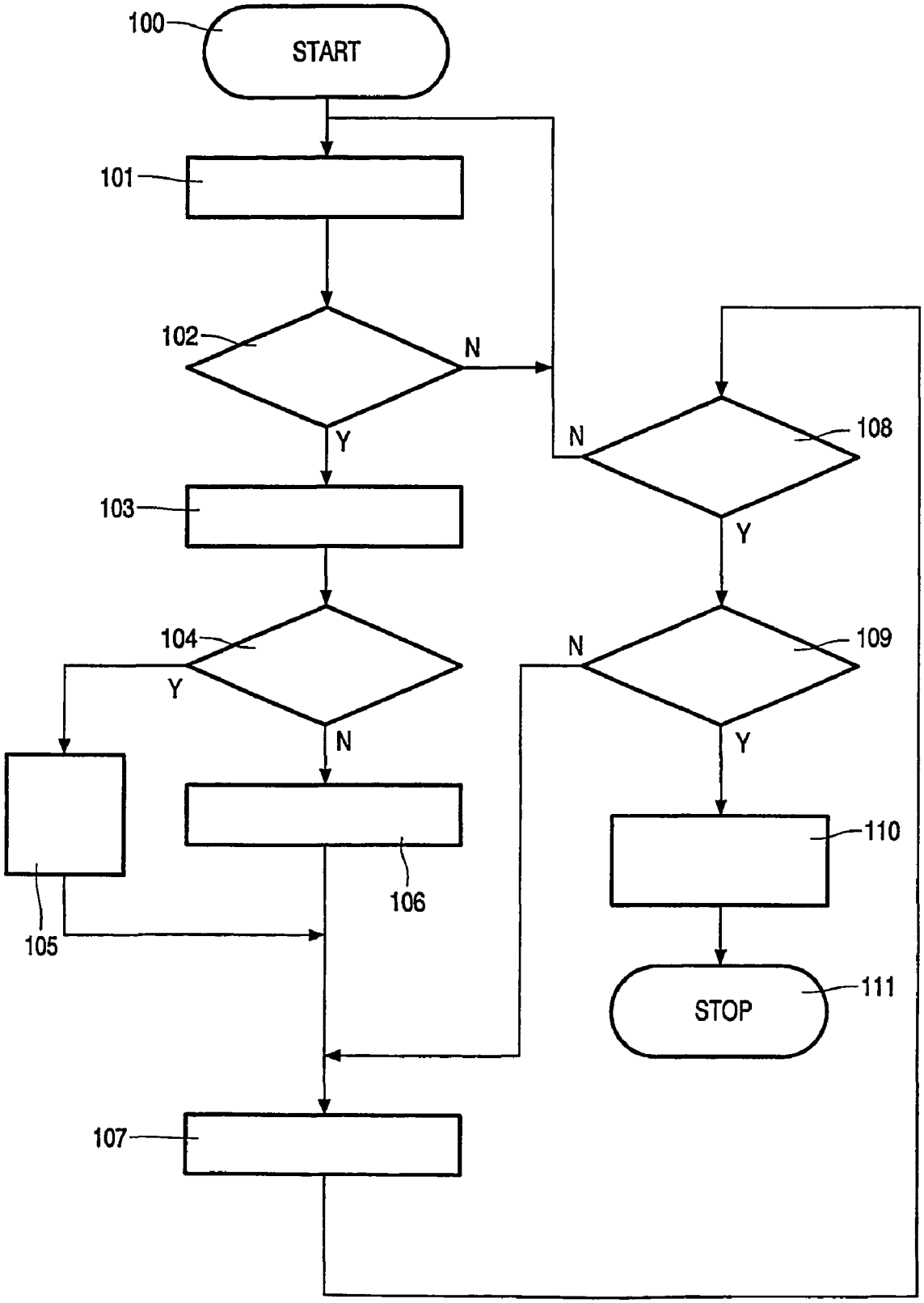

This invention relates to a seating device with sensing of the positions of the limbs of a human body, comprising control means which is arranged to receive values from the sensors and sensors that are placed to sense the positions of the limbs of the human body.

Moreover, the invention relates to a method of avoiding ergonomic problems with a seating device, the method comprising the steps of sensing the presence of a human body.

Seating devices are used in many places, e.g. placed in an office area for use when people are operating personal computers for reading or typing information, other applications are in cars, vehicles and in public transportation such as trains, buses or aeroplanes. Seating devices are also used when people are sitting in waiting rooms, e.g. waiting at the dentist, at the airport, etc. Other applications are at home, at entertainment places, in a manufacturing environment working as an operator in a plant, at restaurants, in cinemas, theatres and other places where it is appropriate to be seated.

Such seating devices are often adjustable in the seat, the backrest and with adjustment of the height of the seat, thereby the seating devices can be adjusted to the user's preferred seating habit.

JP 08-293085 discloses a chair for the detection of sleep when a person is driving. The chair is equipped with one acceleration sensor and four pressure sensors. These sensors are used to detect whether a person is sitting straight up or not. The number of sitting straight-ups and not-sitting straight-ups is counted to detect whether a person is driving asleep or not. When asleep-driving is detected an alarm device is operated to give an alarm.

However, the prior art has not proposed any solution to the problem that people may be seated or working feeling comfortable, even though—from an ergonomic point of view—they are seated in a wrong position or working in a wrong repetitive manner. The problem is that people may sit feeling comfortable, without knowing that the seating position incurs—over time—damage or strains in the limbs. Another problem is that people may be sitting in a wrong position and working—often in a repetitive manner—without knowing and feeling that their repetitive working manner and sitting habit also—over time—incur strain or damage in the limbs during the working hours. Some times the problems are recognised, people feel discomfort and people feel that the seating could be improved because they feel they are seated wrongly or feel that they are working in a wrong or too repetitive manner.

However, often people do not know what could exactly be done to overcome the problem. Such discomfort may arise either from a static wrong position of the human limbs or from Repetitive Strain Injury or from a combination of both. Repetitive Strain Injury is known to be caused by repeated, substantially identical movements and in particular arm, wrist or finger movements over a long period when operating typewriters keyboards, digital input devices or other manually operable devices, for example, in an office, manufacturing environment or at home. Additionally, many people have pain in the limbs after many hours of sitting in the same static position.

Generally, pain and discomfort can be considered as a consequence of a wrong or misplaced position of one or more of the human limbs when seated or from Repetitive Strain Injury or from a combination of both.

These problems are solved when the seating device mentioned in the opening paragraph further comprises a database with ergonomic data for the human body, and where the control means is arranged to provide a warning signal representing detected strain or damage in the limbs in response to the ergonomic data and sensor values, where the sensors are placed in predetermined positions in or around the seating device.

The ergonomic data may hold information about the limbs (shape, size, etc.) and other injury strain complains of the user; the ergonomic data will be described in more detail later.

Consequently, the seating device may give a warning signal to the user when the ergonomic data combined with sensors sensing the positions of the limbs of the human body indicates that limbs are wrongly placed or working in a wrong repetitive manner.

In an expedient embodiment the sensors comprise a pressure sensor, a temperature sensor, a proximity sensor or a camera. Any sensor type which can see, sense or measure the pulse or the heartbeat of a body may be used—thus any sensor which in any way can detect the presence of the human body may be used: e.g. a pulse sensor, a heartbeat sensor, a touch sensitive sensor type or a photocell sensor type may be used too.

The sensors are placed in predetermined positions that comprise the armrests positions, the headrest position, the backrest position, the footrest position and the seat position of the seating device, or a camera is placed in a position where it is arranged to take a picture of the limbs of the human body. Thereby, it is ensured that any limb placed anywhere in the seating device may be sensed—even those limbs not touching the seating device may be sensed too.

In a preferred embodiment the control means comprises an interface which is arranged to control the seating device, to input data or to emit a warning signal. Thereby the seating device may be remote-controlled by means of a Bluetooth interface, a USB connection or an IrDa port, thus an external electronic device, which may be a personal computer or any other computer, may control the seating device instead of or in addition to a processor in the control means.

In a preferred embodiment the control means is arranged to emit warning signals when the user is seated wrongly or is working repetitively wrongly. Thereby, different warning signals, which may be emitted by lamps, by light emitting diodes, by a vibrator, by a loudspeaker, by a piezoelectric speaker, by an earphone, by a headphone or by use of a buzzer, may give a warning to the user. Further, the warning signal may be a spoken message emitted by the loudspeaker, the piezoelectric speaker, the earphone or by the headphone informing the person seated in the seating device that the position should be changed or the person is invited to take a break or to take a walk. Thus, the warning signal is given to indicate whether the user is seated wrongly or whether—as a typical example—the user moves the arm, wrist and fingers in a wrong way or a wrong repetitive way.

In a preferred embodiment the control means comprises a data input device arranged to enter ergonomic data, to retrieve ergonomic data or to emit a warning signal. The data input device may comprise a keyboard, a display or a computer monitor as a display. The data input device may also be a pointing device, e.g. a computer mouse, a touch screen, a digital pen or the like, a joy stick, a game pad, a remote control, or any other data input device. Thereby, the user seated in the seating device may communicate and retrieve information in various ways with the control means.

In a preferred embodiment the control means comprises a database with ergonomic data with a personal ID as a unique key to the database. The database may contain various information about the human body: weight and length of the body, age, the length of the body parts such as neck, left and right arm, left and right hand, left and right foot and left and right leg. The database may further contain information about the diameter of the body parts such as neck, left and right arm, left and right hand, left and right foot and left and right leg and other characteristic shapes of the body limbs.

Additionally, the database may further contain information about abnormal shapes of body limbs, injury strain complaints referring to specific body limbs.

Moreover, the database may further contain information about body limbs, where a static situation should be especially avoided.

Finally, the database may further contain information about preferred exercise to be suggested to the user seated in the seating device, when the warning signal is given.

In a preferred embodiment the seating device may be any type of chair. The chair may be any of the following chairs: an office chair, an armchair, a wheel chair, a rocking-chair, a chair used in an exercise machine, a winged armchair, a sleeper seat, or any other chair used when people are seated. Thus, in any chair type it may be supervised whether the person seated in the chair incurs strain and or damage to the limbs.

The problems previously mentioned are further solved by a method of avoiding ergonomic problems with a seating device. The method comprises the step of Sensing the presence of a human body—as an initial step the method checks for the presence of a person in the seating device, thereafter the step of Querying a database for ergonomic data—. Here ergonomic data by use of a personal ID for the person using the seating devices is fetched from the database of the seating device, thereafter the step of Sensing at least one position of the positions of the limbs of the human body—. Thereby positions of the limbs of the body of the user are known by the seating device, thereafter the step of Deciding whether strain or damage is incurred in the limbs—. Here the seating device combines the sensed positions of the limbs of the body with the ergonomic data to decide whether to give a warning signal or not to the user, thereafter the step of Giving a warning signal if strain or damage is incurred—. A warning signal is given when either strain and or damage is incurred in the limbs of the person seated in the seating device. The warning signal may be given by a visible signal, an audible signal or by use of a vibrator signal.

The method of avoiding ergonomic problems with a seating device may further comprise the step of allowing a user to enter personal ID for retrieving or entering ergonomic data from or to the database—thereby the person may uniquely identify himself or herself to retrieve or to enter his or hers personal ergonomic data from or to the database.

Figure 2:
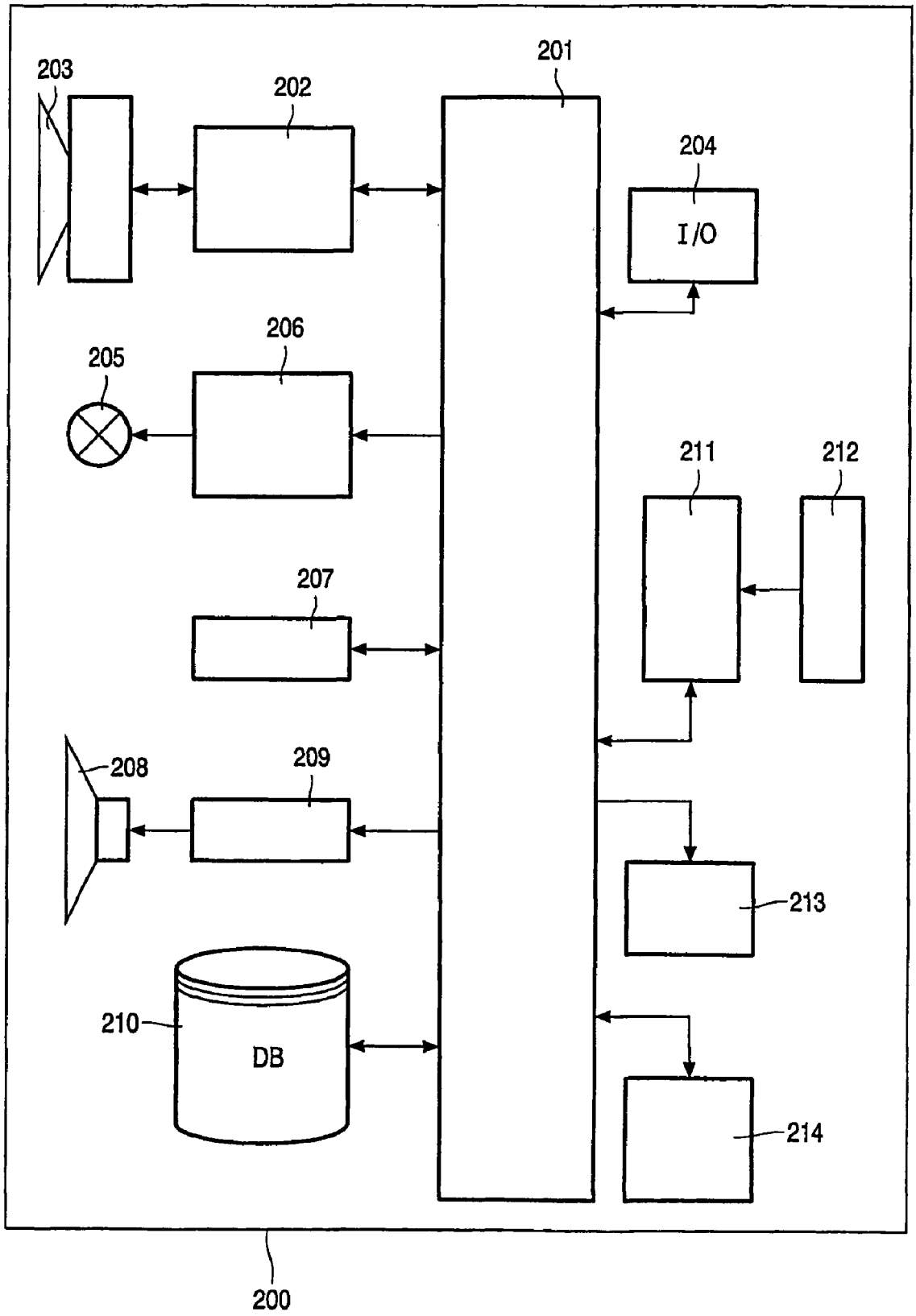
Figure 3:
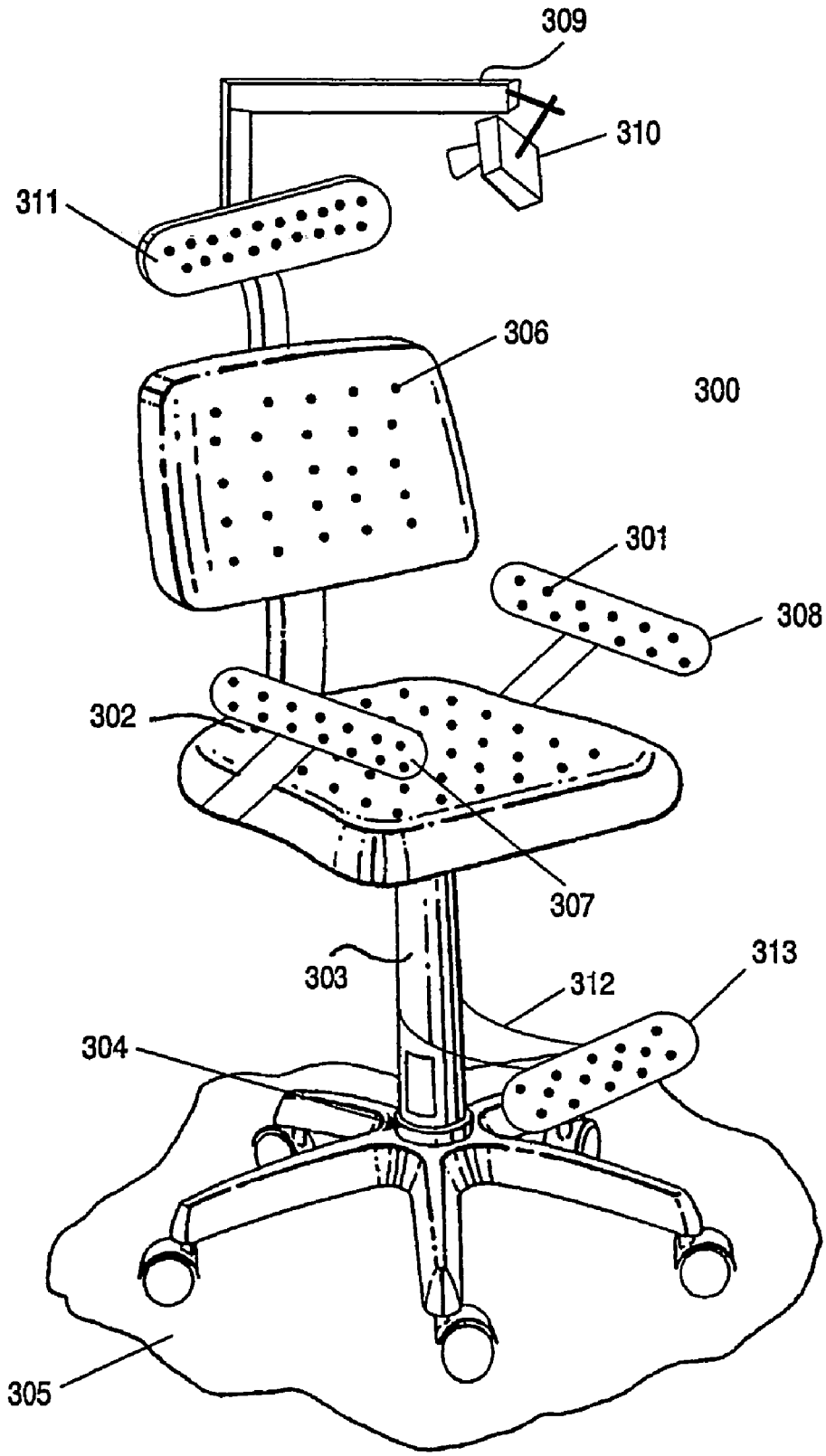

The invention will be explained more fully below in connection with a preferred embodiment and with reference to the drawing, in which:

FIG. 1 shows a flowchart for a method of avoiding ergonomic problems with a seating device, FIG. 2 shows a block diagram of the control means; and FIG. 3 shows a perspective view of a seating device.

FIG. 1 shows a flowchart for a method of avoiding ergonomic problems with a seating device. The method starts in step 100 leading to the first step in the method, step 101, where the control means reads sensor values from the sensors placed on and around the seating device. In step 102 it is decided whether a person is present in the seating device on the basis of the sensor values. If a person is not present because none of the sensors senses human limbs, the method is redirected back to step 101 still waiting for a person to be present.

If a person is present because one or more of the sensors senses human limbs, the method continues to step 103. In this case the person is asked by means of the data input device in the control means to enter the user's personal ID. This ID is compared with possibly known personal IDs in step 104. If the personal ID is known, the database in the control means is queried for ergonomic data in step 105. If the personal ID is not known, in step 106 the user is requested to enter ergonomic data which together with the personal ID is stored in the database. The database may have several sets of ergonomic data, where the personal ID is the unique key to each set of these data. This gives the possibility that the seating device may be used by several persons one at a time, each person having a unique set of ergonomic data identified by means of the unique user's personal ID.

In step 107 like in step 101, the control means again reads the sensor values from the sensors placed on the seating device.

In step 108 like in step 102 it is decided whether the person is still present in the seating device on the basis of the sensor values. If the person is not present any more because none of the sensors senses parts of the human limbs, the person has left the seating device, and the method goes back to step 101.

If a person is present because one or more of the sensors senses human limbs, the method continues to step 109.

In step 109 an ergonomic decision may be taken as to whether strain or damage is incurred in the human limbs for the person seated in the seating device. Generally, if no ergonomic decision is taken—this means that neither strain nor damage is incurred in the human limbs. The ergonomic decision is taken by the control means. The ergonomic decision is generally comprised of a combination of sensor values and the ergonomic data The ergonomic decision may use measured time values for each sensor for the duration of the presence of the part of the human limb close to that sensor. The combinations of the sensor values may be any of not, and, or, nand or nor, which is known from boolean algebra and the combinations of the sensor values may also be a corresponding combination of analog sensor values or both. The combinations of the sensor values may also be mathematical computations of the sensor values, additionally the sequence in the sensing of the sensor values may also be a part of the combination of the sensor values. A person skilled in physiotherapy and with an insight in the human anatomy and with an insight in—and historical knowledge of—Repetitive Strain Injury and damages incurred in the human limbs may also be involved in how the combinations of the sensor values are formulated. Further, the ergonomic decision may be comprised of the number and the duration of repetitive detections of the presence of the parts of the human limbs sensed by a sensor. If a user has special complaints of Repetitive Strain Injury or suffers from other pains, these circumstances may also be part or parts of the ergonomic data and may also be taken into account together with the combinations of sensor values to give the ergonomic decision. When an ergonomic decision is taken, it indicates that either a Repetitive Strain Injury is likely to happen—if the movement or movements are not stopped—or that certain parts of a human limb have been static for a long time and other pains are likely to occur if the situation is not stopped. In other words—the ergonomic decision decides whether strain or damage is incurred in the limbs of the person seated in the seating device. This is indicated in step 110 by giving a warning signal.

If no ergonomic decision is taken meaning that neither strain nor damage is incurred in the human limbs for the person seated in the seating device, the method continues in step 107, where the control means continuously reads the sensor values from the sensors placed on the seating device.

If an ergonomic decision is taken the method continues in step 110, where a warning signal is given. The warning signal given in step 110 may be a simple buzzer sound, a vibration, a spoken message or a sound, a text message with graphics, one or more LEDS or lamps indicating the warning signal or a warning message to be sent to a personal computer or other electronic equipment communicating wireless with the seating device. The warning signal given in step 110 may tell what the cause is for the warning. In other words, it is warned whether strain and or damage is incurred in the limbs of the person seated in the seating device. The warning signal—as an example—may further inform the user to switch from a bad to a better position, to stop repetition of a movement or movements, to take a break or to leave the seating device for a walk or to do an exercise suggested by the seating device. The method stops in step 111.

In case the user wants to enter the personal ID—even though the method is not in step 103—it is possible to enter the personal ID by means of the data input device—whenever the user so wants, thereby forcing the method to continue from step 104.

FIG. 2 shows a block diagram of the control means. It is comprised of a processor, a battery, a database, inputs from sensors and outputs for the warning signal and a wireless interface. The control means 200 comprises all parts shown in this figure. Reference numeral 201 is the processor. The processor controls all inputs and outputs connected to the processor. It may be any commercially available processor, an application-specific integrated circuit, another integrated circuit or electronic circuitry dedicated for the purpose.

The processor is connected to an image processor 202 for processing image data from a camera 203. The camera is used to take an image of the person seated in the seating device. The image may be used and processed to determine the positions of the human limbs. The camera may be one of several possible sensors connected to the control means. Additionally or alternatively sensors 212 may be pressure sensors, temperature sensors, or proximity sensors, or any other sensor type which can detect or see the human body or parts thereof.

These sensors may be connected to the system via the sensor interface 211. The sensor interface powers the sensors connected to the sensor interface and converts the levels from the sensors to a level which may be read by the processor.

The sensors 212 connected to the sensor interface 211 as well as the camera 203 may be used to sense the presence of the part or the parts of the human limbs and as a consequence to sense whether and how a person is present and moving himself or herself in the seating device.

In order to enable a user to communicate with the control means to enter or to retrieve data including a warning signal from the control means it comprises a data input device 207. In one embodiment of the invention the data input device may be an interactive display. The interactive display is capable of providing information to the user in text and graphics including images and graphical information. The control means is capable of receiving input from the user in that the interactive display can be touch-sensitive. Thereby it is possible to make a keyboard appear on the interactive display. Alternatively, or additionally, a user's handwriting on the display may be interpreted. In another embodiment of the invention the data input device may comprise a keyboard and a display or a computer monitor as a display. The data input device may also be a pointing device, e.g. a computer mouse, a touch screen, a digital pen or the like, a joy stick, a game pad, a remote control, or any other data input device.

In order to store ergonomic data and personal ID about a user the control means comprises a database 210 for storing information in a structured and searchable way. For the purpose of communication with a stationary computer, computers on the internet or other electronic equipment including mobile phones as input device and for displaying a warning signal information and for manipulating ergonomic data, the control means comprises an input/output (I/O) interface 204. The I/O interface may be a wireless interface e.g. a so called IrDa port or a Blue Tooth interface. The I/O interface may also be a non wireless interface, as an example the USB interface or the RS 232 serial interface. It may therefore also be possible to control the seating device by a personal computer, which may also be used when people use the personal computer as part of their work when the personal computer is operated for reading or typing information.

Further, by means of the digital signal interface 206 a warning signal may be given to the user by means of a pattern sent to 205 a lamp or series of lamps, or a pattern sent to 205 a LED or a series of LEDs connected to the digital signal interface.

The sound device 208 may be used for emitting sound as a warning signal. The sound device may be a loudspeaker, a piezoelectric speaker, an earphone, a headphone or a buzzer.

Moreover, a warning signal may be given by use of the audio interface 209, as a sound or a spoken message sent to the sound device.

Additionally, or alternatively, a warning signal may be given by powering the vibrator 213 connected to the processor. The vibrator is placed in the seating device. 204, 205, 207, 208 and 213 may be used one at a time or in a combination to give the warning signal.

Since the seating device may be movable or may be a stand alone device it is primarily powered by a rechargeable battery 214.

The ergonomic data is stored in a table with the personal ID as a unique code for later retrieval, manipulation and storing. The database may contain a possibility of storing multiple users each identified by a unique personal ID. The personal ID comprises at least 4 characters in a free selectable combination of letters and digits. When a person enters the seating device for the first time, the user may select a unique personal ID freely or use the suggestion for a unique personal ID from the control means.

Ergonomic data is physical data about the human body, injury strain complaints, static situations to avoid and preferred exercises. The ergonomic data therefore at least comprises the following:

weight of body, length of body, age length of the following body parts: neck, left and right arm, left and right hand, left and right foot and left and right leg;

diameter of the following body parts: body, neck, left and right arm, left and right hand, left and right foot and left and right leg;

characteristic shapes of body limbs abnormal shapes of body limbs injury strain complaints referring to body limbs body limb, where a static situation should be avoided preferred exercise to be suggested when a warning signal is given.

Before the first use of the seating devise it may be recommended to consult a person skilled in physiotherapy to assure that the ergonomic data is prepared before the entering of the ergonomic data. The seating device may suggest default ergonomic data on the basis of the values sensed by the sensors. These data may be changed before entering. Alternatively, the seating device may be customized to the person, thereby the ergonomic data is previously entered before the seating device is delivered, so that it may not be necessary to enter ergonomic data and personal ID.

FIG. 3 shows a perspective view of a seating device. In a preferred embodiment of the invention the seating device 300 is a chair 301. It comprises a seat 302 supported on an elongate leg 303, which may have an underframe 304 with four legs standing on a horizontal surface 305. Mounted to the leg 303 by use of support for footrest 312 is a footrest 313, where the user of the chair may rest his foot. For the support for the back, there is provided a backrest 306. Correspondingly for the support of the arms, there are provided an armrest 307 for the right arm and an armrest 308 for the left arm. The sensing of the positions of the human limbs may be sensed by a camera 310, which may be connected by means of an arm 309 to the backrest. On the vertical part of the arm 309 there may be mounted a rest for the head, the headrest 311.

In another preferred embodiment the seating device may have a spindle for adjustment of the height of the seat. Additionally, or alternatively, the seating device may also have adjustments for the seat angle, for the positions of the backrest, the headrest, the armrests and the footrest. Alternatively, the underframe may comprise a plate and may be without rollers. The underframe may also comprise three or five legs or like in an armchair the underframe may comprise two rails.

The dots shown in FIG. 3 on the armrests, the headrest, the backrest, the footrest and the seat indicate possible positions of the sensors previously mentioned for sensing the positions of the human limbs. The positions of the sensors shown are only examples of positions of sensors, other positions of sensors may be used as well.

The term seating device may comprise any type of chair used in a situation when people typically have to be seated or sitting for several hours. As an example the seating device may be a chair used in an office area for use when operating personal computers for reading or typing information. Other examples may be a chair used during transportation such as in cars, in motorcycles, in vehicles, in trains, in buses, in aeroplanes, in boats, in ships, in military equipment, in spacecrafts. More examples may be a chair for entertainment purposes when playing computer games, for relaxing, etc. Other examples may be a chair used in waiting rooms, at home, in a manufacturing plant, in restaurants, in cinemas, in theatres, and other places where it is appropriate to be seated. Alternatively, the seating device may also be an armchair, a wheel chair, a rocking-chair, a chair used in an exercise machine, a winged armchair, a sleeper seat, or anywhere used as a device when people have to be seated and or to work for a longer time.

A computer readable medium may be magnetic tape, optical disc, digital video disk (DVD), compact disc (CD or CD-ROM), mini-disc, hard disk, floppy disk, smart card, PCMCIA card etc.

The invention claimed is:

1. A seating device with sensing of the positions of the limbs of a human body, comprising:

control means which is arranged to receive values from the sensors; and sensors that are placed on the seating device to sense the positions of the limbs of the human body;

wherein the seating device has a database with ergonomic data for the human body, the control means is arranged to provide a warning signal representing detected strain or damage in the limbs in response to the ergonomic data and the sensor values including detection of a repetitive motion of the limbs by the sensors that are placed or the seating device, and wherein the sensors are placed in predetermined positions of the seating device.

2. A seating device according to claim 1, wherein the sensors comprise a pressure sensor, a temperature sensor, a proximity sensor or a camera.

3. A seating device according to claim 1, wherein the predetermined positions comprise at least one of armrests positions, headrest position, backrest position, footrest position and seat position.

4. A seating device according to claim 1, wherein the control means comprises an interface arranged to control the seating device or to input data.

5. A seating device according to claim 1, wherein the control means is arranged to emit the warning signal when the user is seated wrongly or is working repetitive wrongly.

6. A seating device according to claim 1, wherein the control means comprises a data input device arranged to enter user data or to retrieve said user data.

7. A seating device according to claim 1, wherein the seating device is a chair.

8. The seating device of claim 1, wherein the predetermined positions comprise a position arranged to take a picture of the limbs of the human body.

9. The seating device of claim 1, wherein the control means comprises an interface arranged to emit the warning signal.

10. The seating device of claim 1, wherein the ergonomic data includes user specific data of a user.

11. The seating device of claim 10, wherein the user specific data includes at least one of a length of a body of the user, age of the user, length of body parts of the user, diameter of the body parts, and shapes of the body parts.

12. The seating device of claim 1, wherein the warning signal includes suggesting to a user of the seating device at least one of stooping said repetitive motion, a better position, and an exercise.

13. The seating device of claim 1, wherein the detection of said repetitive motion includes detection of at least one of a number and a duration of said repetitive motion.

14. The seating device of claim 1, further comprising at least one of a pulse sensor, a heartbeat sensor and a touch sensitive sensor configured for detecting a presence of the human body.

15. A seating device with sensing of the positions of the limbs of a human body, comprising:

control means which is arranged to receive values from the sensors; and sensors that are placed to sense the positions of the limbs of the human body;

wherein the seating device has a database with ergonomic data for the human body, the control means is arranged to provide a warning signal representing detected strain or damage in the limbs in response to the ergonomic data and the sensor values including detection of a repetitive motion of the limbs, and wherein the sensors are placed in predetermined positions, wherein the database includes a personal ID as a unique key to the database.

16. A method of avoiding ergonomic problems with a seating device, wherein the method comprises the acts of:

sensing the presence of a human body;

querying a database for ergonomic data;

sensing at least one position of the positions of the limbs of the human body including sensing a repetitive motion of at least one of the limbs by sensors that are placed on the seating device;

deciding whether strain or damage is incurred in the limbs;

giving a warning signal if strain or damage is incurred.

17. A computer program product comprising program code means stored on a computer readable medium for performing the method of claim 16 when said computer program is run on a computer.

18. The method of claim 16, wherein the sensing act includes sensing at least one of a number and a duration of said repetitive motion.

19. The method of claim 16, wherein the warning signal includes suggesting to a user of the seating device at least one of stopping said repetitive motion, a better position, and an exercise.

20. A method of avoiding ergonomic problems with a seating device, wherein the method comprises the acts of:

sensing the presence of a human body;

querying a database for ergonomic data;

sensing at least one position of the positions of the limbs of the human body including sensing a repetitive motion of at least one of the limbs;

deciding whether strain or damage is incurred in the limbs;

giving a warning signal if strain or damage is incurred; and allowing a user to enter personal ID for retrieving or entering user data from or to the database.

21. A seating device comprising:

sensors that are placed to sense positions of limbs of a human body seated in the seating device;

control means arranged to receive sensor values from the sensors; and a database including ergonomic data for the human body and user specific data of a user that includes complaints of the user;

the control means being further arranged to provide a warning signal representing detected strain or damage to the human body in accordance with the ergonomic data and the sensor values.

* * * * *